United States Patent [19]

Kanai et al.

[11] 4,358,920

[45] Nov. 16, 1982

[54] APPARATUS FOR WRAPPING A SHEET ARTICLE

[75] Inventors: Kiyoshi Kanai, Tokyo; Masashi Mamura, Kawagoe, both of Japan

[73] Assignee: Lotte Co., Ltd., Tokyo, Japan

[21] Appl. No.: 156,393

[22] Filed: Jun. 4, 1980

[51] Int. Cl.[3] ..... B65B 11/28; B65B 63/00

[52] U.S. Cl. ..... 53/516; 53/234; 53/253; 198/484

[58] Field of Search ..... 53/225, 234, 516, 579, 53/252, 253; 198/481, 484

[56] References Cited

U.S. PATENT DOCUMENTS

| | | | |
|---|---|---|---|
| 695,016 | 3/1900 | Rose | 53/234 X |
| 931,646 | 8/1909 | Price | 53/234 X |
| 1,964,411 | 6/1934 | Beutel | 53/234 |
| 2,749,692 | 6/1956 | Conti | 53/234 |
| 2,952,105 | 9/1960 | Schur | 53/234 X |
| 3,818,675 | 6/1974 | Griner | 53/234 X |
| 3,899,865 | 8/1975 | Pevaz | 53/234 |
| 3,969,873 | 7/1976 | Klar | 53/234 X |
| 4,006,577 | 2/1977 | Schoppee | 53/234 X |
| 4,035,990 | 7/1977 | Hallam | 53/228 X |
| 4,211,055 | 7/1980 | Long | 53/253 |

FOREIGN PATENT DOCUMENTS

| | | | |
|---|---|---|---|
| 600690 | 12/1957 | Italy | 198/481 |

*Primary Examiner*—John Sipos

*Attorney, Agent, or Firm*—Young & Thompson

[57] ABSTRACT

A wrapping device in which two rotating drums (18, 20) of identical circumferential velocities are arranged symmetrically and one of the rotating drums (18) is provided around its circumference with a number of recesses (36) adapted to receive the sheet articles from an open bottom (32) of the hopper (16) in which a number of the sheet articles are stored in superposition whereas the opposite rotating drum (20) is provided around its circumference with a number of receivers (78) which first hold the wrapping paper and then catch the sheet article transmitted from the rotating drum (18), so that the wrapping operation is continuously performed by the synchronous rotation of the wrapping drums (18, 20) with folding of the wrapping paper.

10 Claims, 22 Drawing Figures

FIG.8a
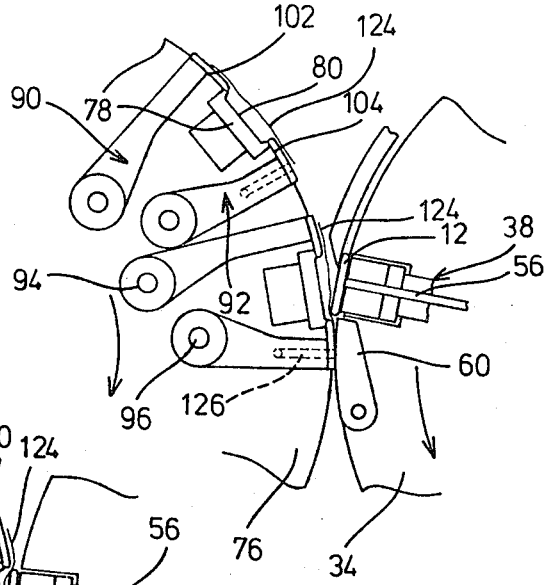
FIG.8b
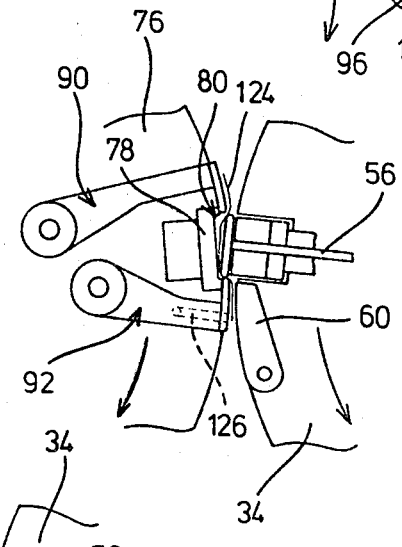
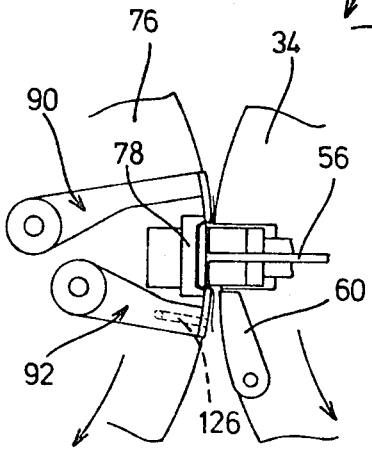
FIG.8c
FIG.8d
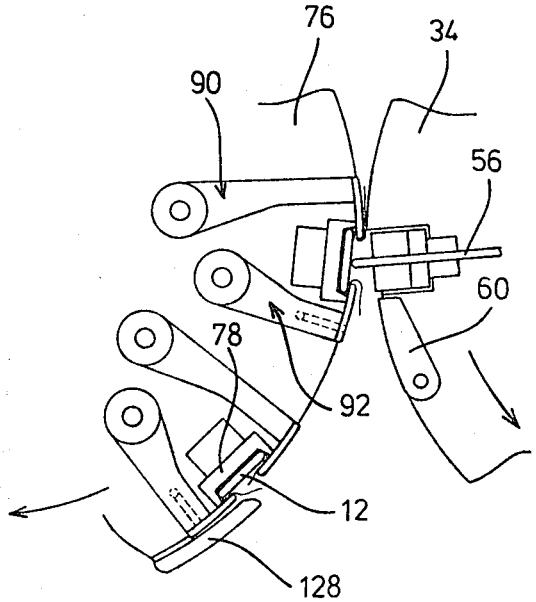

APPARATUS FOR WRAPPING A SHEET ARTICLE

TECHNICAL FIELD OF THE INVENTION

This invention relates to an apparatus for wrapping a sheet article such as a sheet chewing gum at a high wrapping efficiency.

BACKGROUND ART

In the conventional wrapping machine for a sheet article such as sheet chewing gum, a rotating drum at its circumference is provided with a number of equidistant recesses for receiving the sheet article which after the wrapping paper has been placed over the circumference of the rotating drum is pressed into each recess so that the three faces of the sheet article are encompassed by the wrapping paper and then an intermittent rotation of the feeding drum for the predetermined turning angle at 180° for example permits transfer of the sheet piece from the feeding drum onto the wrapping drum while folding the opposite ends of the wrapping paper to perform the wrapping operation.

In the conventional wrapping arrangement, however, the feeding as well as wrapping drums are rotated intermittently and the sheet article with the wrapping paper are pressed into the recesses provided around the circumference of the drum. Hence, the wrapping efficiency of the conventional wrapping arrangement is usually from 500 to 600 pieces per minute and even in the improved arrangement the maximum wrapping efficiency is 1,300 pieces per minute. Further, the discontinuous operation of the arrangement causes undesired abrasion of the elements with development of noise while increasing generation of the defective wrappings with difficulties in the inspection and the working properties.

DISCLOSURE OF THE INVENTION

After an intensive research to obtain a device of more increased wrapping efficiency and free of any intermittent or discontinuous wrapping operation, there is provided an improved wrapping arrangement in which two rotating drums of identical circumferential velocities are arranged symmetrically and one of the rotating drums is provided around its circumference with a number of recesses adapted to receive the sheet articles from an open bottom of the hopper in which a number of the sheet articles are stored in superposition whereas the opposite rotating drum is provided around its circumference with a number of receivers which previously holds the wrapping paper and then catches the sheet article transmitted from the first rotating drum (18), so that the wrapping operation is continuously performed by the synchronous rotation of the wrapping drums entailing the folding operation of the wrapping paper. By this arrangement, the wrapping efficiency may be remarkably increased by simple operation and with improved working properties.

It is, therefore, a general object of the invention to provide an apparatus of improved wrapping efficiency and with less defective wrappings.

A principal object of the invention is to provide an apparatus for wrapping a sheet article which comprises a means for cutting an elongated sheet article into a predetermined size for continuous supply, a feeding drum for transferring each cut piece of the sheet material while holding the cut piece on the circumference of the feed drum, a wrapping drum means which is arranged in confront to said feed drum and provided along its circumference with means for receiving the cut sheet article, a paper feed mechanism for continously supplying a wrapping paper to the wrapping drum and a means for transmitting the cut sheet article from the feeding drum to the wrapping drum.

The means for cutting an elongated sheet article into a predetermined size may be comprised of two sets of separate rolls adapted to embrace the sheet article which is previously provided with cutting lines and the peripheral velocity of the roll located on the delivery side of the sheet article is preferably greater than the velocity of the roll located on the receiving side of the article.

The means for continuously supplying the sheet article may be comprised of a hopper which is positioned proximate to the cutting means for receiving each cut piece of the sheet article in superposition and the hopper is conveniently provided at its lateral portion with an oscillation generator. The bottom of the hopper is open to expose it to the circumference of the feeding drum. Further, the feeding drum around its circumference is provided with a number of equidistant recesses and each recess communicates with a chamber formed for receiving a plunger means which urges the sheet article outwardly.

The wrapping drum around its circumference is provided with a number of article receivers and each article receiver is associated with a first lever member for folding a side of the wrapping paper and with a second lever member for folding an opposite side of the wrapping paper and at least one of the lever members is provided with a suction port for holding the wrapping paper and one each of each lever member is operatively associated with a cam follower which is in turn urged into contact with a fixed cam. Alternatively, the ends of the lever members may be pivoted to a common shaft and each lever member is conveniently provided with a pin which is operatively engaged with a cam follower which is in turn urged into contact with the fixed cam.

The wrapping drum at a selected portion on the circumference thereof is preferably associated with a folding line forming disc and a press roller which is followed by a guide holder for folding the opposite ear portions of the wrapping paper.

The paper feed mechanism may include roller units disposed above the wrapping drum with a cutting unit so that the wrapping paper sheet continuously supplied is cut into a predetermined size and then placed seriatim onto the article receiver of the wrapping drum.

The typical means for transmitting the cut sheet article from the feeding drum to the wrapping drum may be a plunger which at its one end is operatively associated with a cam follower which is in turn urged into contact with a fixed cam. The plunger at its extremity is provided with an extensible pushing member and one end of the extensible pushing member is operatively associated with a cam follower which is in turn urged into contact with a fixed cam for operating the pushing member. The plunger is resiliently suspended in the recess provided in the circumference of the feeding drum.

The plunger is disposed in abutment with the lever member which is tilted, when it comes proximate to the bottom of the hopper, to guide the sheet article into the cavity formed in the extremity of the plunger. Alternatively, the plunger at its extremity is provided with a resiliently extensible pushing member together with separate resiliently extensible side plates adapted to embrace the sheet article.

The preferred ways of carrying out the invention are described in detail below with reference to drawings which illustrate some specific embodiments, in which:

BRIEF DESCRIPTION OF THE DRAWINGS

FIGS. 8*a* to 8*d* are schematic views showing the operations of the first rotating drum in association with the second rotating drum;

PREFERRED EMBODIMENTS OF THE INVENTION

Figure 1:
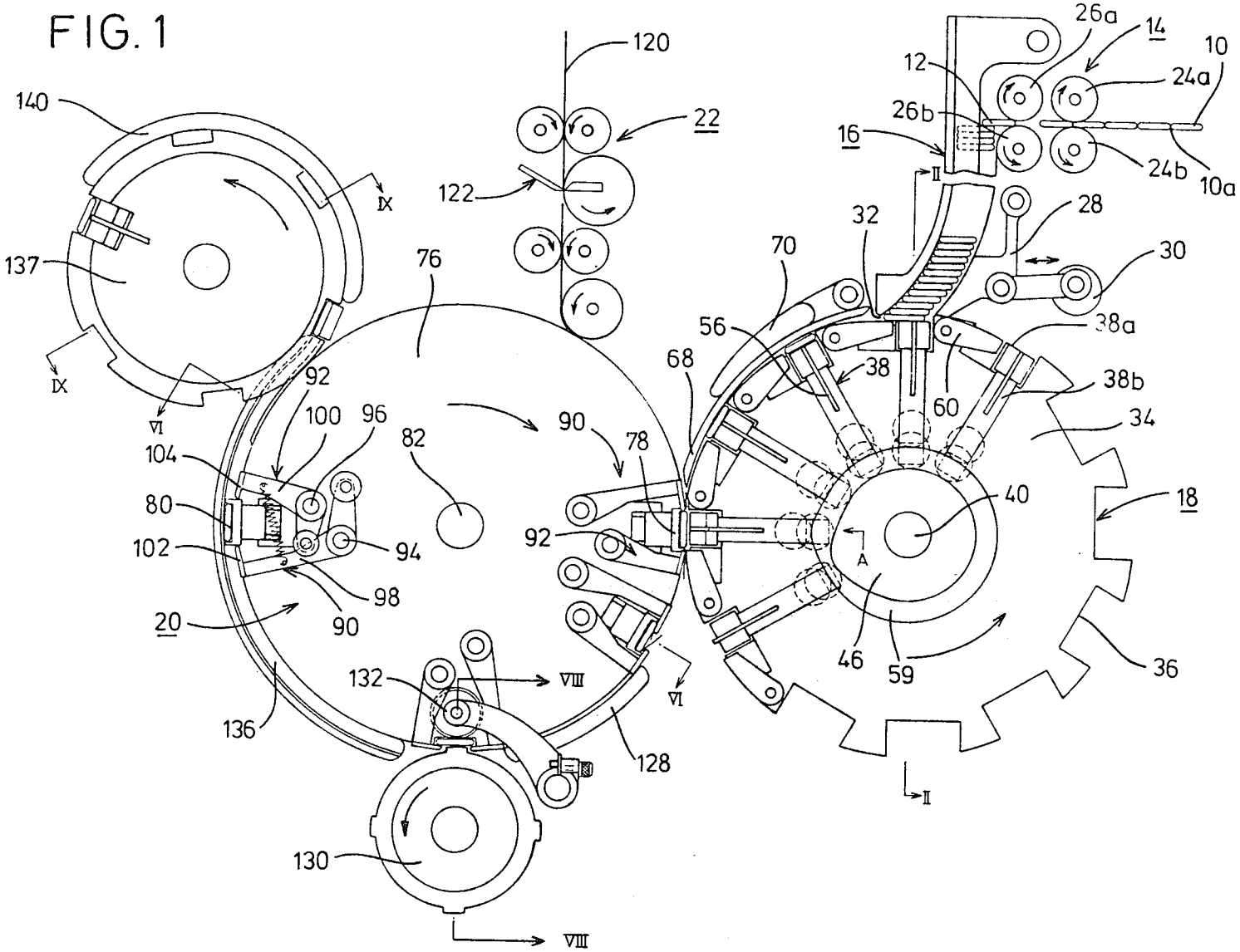
FIG. 1 is a schematic view of the apparatus for practicing the method according to the invention.

FIG. 1 shows one embodiment of the apparatus according to the invention for continuously packaging sheet chewing gum, which essentially comprises a cutting unit 14 for cutting a continuously extruded sheet of chewing gum 10 with cutting lines into gum pieces 12 of predetermined size, a hopper 16 for storing the cut gum pieces in superposition, a first rotating drum 18 for collecting and transferring a sheet of the chewing gum piece from the bottom of the hopper 16 to a desired position, a second rotating drum 20 which registers with the first rotating drum 18 at a predetermined position to receive the gum piece 12 on a carrier 78 holding a packaging paper for effecting the packaging operation, and a paper feeding mechanism 22 for feeding the packaging paper continuously to the second rotating drum 20.

The cutting unit 14 includes two sets of rotating rollers 24*a*, 24*b* and 26*a*, 26*b* arranged in confronting relation respectively and between these confronting rollers a continuous sheet of chewing gum 10 with cutting lines 10*a* is supplied in series from a conventional scoring machine (not shown). The circumferential velocities of the rollers 26*a*, 26*b* are greater than those of the rollers 24*a*, 24*b* so that the continuous sheet of chewing gum 10 may be cut off along the cutting line 10*a* and between two sets of the confronting rollers. In order to perform the cutting operation smoothly it is preferable to maintain a distance "L" between the two sets of the rollers 24*a*, 24*b* and 26*a*, 26*b* in relation to a distance between the cutting lines provided in the continuous sheet of chewing gum 10 so as to have a relationship of $\iota < L < 2\iota$.

The chewing gum pieces 12 cut by the cutting unit 14 are superimposed in the hopper 16 an oscillation arm 28 strikes the hopper 16 under the action of an eccentric cam mechanism 30 to cause vibration so that undesired adhering of the chewing gum pieces in the hopper 16 may be prevented, thereby to achieve a smooth transfer of the chewing gum from the hopper 16.

Under the hopper 16 thus constructed is arranged the first rotating drum 18, the upper circumference of which is close to the bottom opening of the hopper 16.

The first rotating drum 18 is essentially comprised of a drum body 34 of predetermined width and in the circumference thereof there are provided two or more recesses 36 at predetermined distances in each of which a plunger means 38 is received to catch the chewing gum piece 12 in a the predetermined position and subsequently transfer the gum piece to the desired position where the gum piece 12 is released from the plunger. The plunger means 38 at its external end is provided with a carrier 38*a* of substantially the same size as the chewing gum piece 12.

From the carrier 38*a* extends a rod 38*b* toward a center shaft 40 of the first rotating drum 18 and around the rod 38*b* is mounted a coil spring 42 to press the carrier 38*a* resiliently against the center shaft of the first rotating drum 18. To one end of the rod 38*b* is connected a cam follower 44 which is urged into contact with a cam 46 fixed to the center shaft 40.

Figure 2:
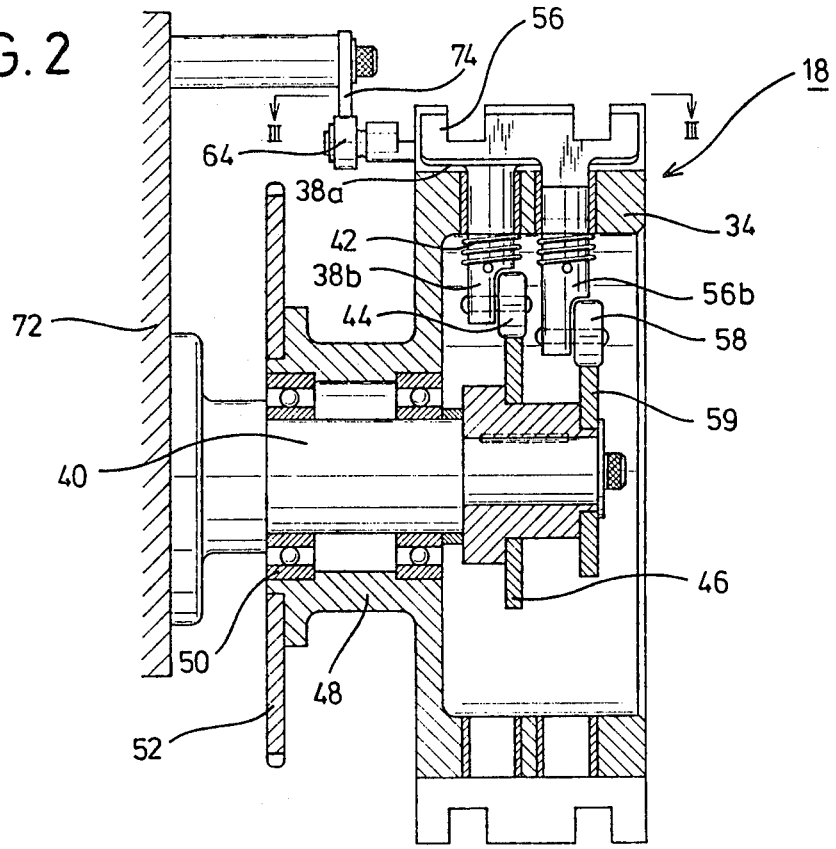
FIG. 2 is a sectional view of the first rotating drum taken along the lines II—II of FIG. 1.

As is shown in FIG. 2, in accordance with one embodiment of the invention, on the drum body 34 is provided a hub 48 which is pivoted through a bearing 50 to an outer circumference of the central shaft 40 inserted into the drum body 34 so that the first rotating drum 18 is coupled to a convenient driving source through a sprocket 52 secured to the hub 48 for performing the turning operation.

The carrier 38*a* of the plunger 38 is provided with a cutting groove 54 (FIG. 3) in which a pushing member 56 is received retractably. From the pushing member 56 extends a rod 56*b* which is resiliently held against the center shaft 40. On one end of the rod 56*b* is mounted a cam follower 58 which is urged into contact with a cam 59 fixed to the center shaft 40 as best shown in FIGS. 1 to 3.

Figure 3:
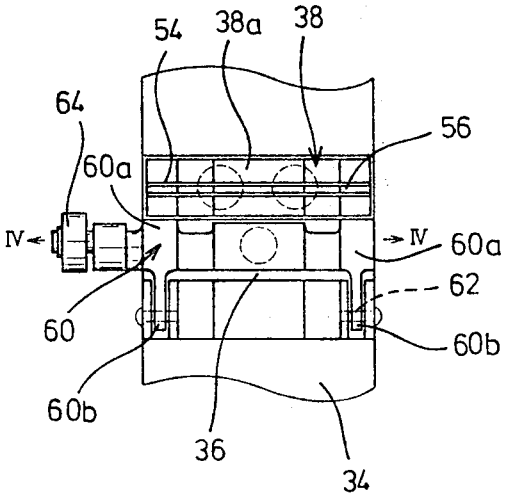
FIG. 3 is a partial plan view of the first rotating drum taken along the line III—III of FIG. 2.
Figure 4:
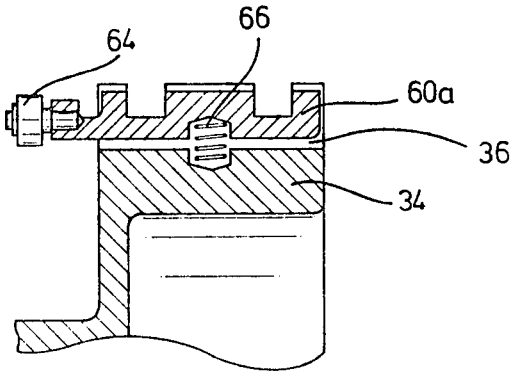
FIG. 4 is a sectional view of the first rotating drum taken along the line IV-IV of FIG. 3.

In FIG. 3 showing a plan view of the recess 36 of the first rotating drum 18, the recess 36 receives the plunger 38 with a lever member 60. The lever member 60 includes a pair of arm members 60*a*, 60*a* pivotably held by the drum 34 through a support pin 62, support members 60*b*, 60*b* provided at the opposite ends of the arm member 60*a*, 60*a* and a cam follower 64 associated with one of the arm members 60*a*. Between the arm member 60*a* and the bottom of the recess 36 is mounted a coil spring 66 to urge the arm member 60*a* against the outer circumference of the drum 34 as shown in FIG. 4.

On the circumference of the first rotating drum 18 is mounted a guide member 68 which extends about 90° from the bottom opening 32 of the hopper 16 and the guide member 68 is externally associated with a brake shoe 70 which is secured to a support frame 72 to which the center shaft 40 of the rotating drum 18 is also fixed.

Figure 5A:
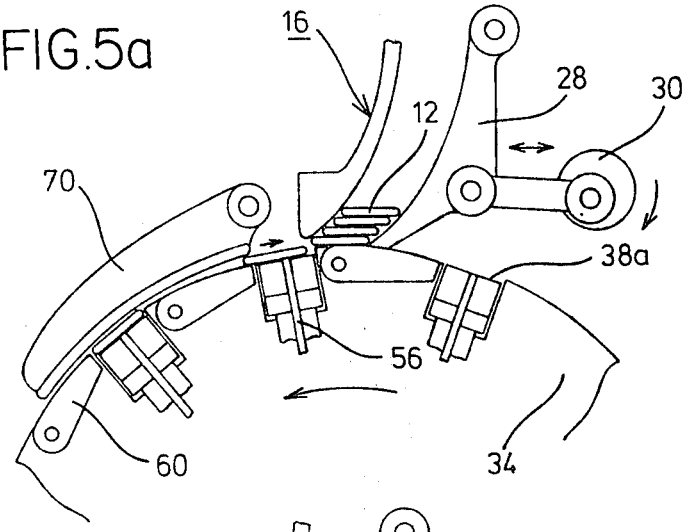
FIGS. 5*a* to 5*c* are schematic views showing the operation of the first rotating drum.
Figure 5B:
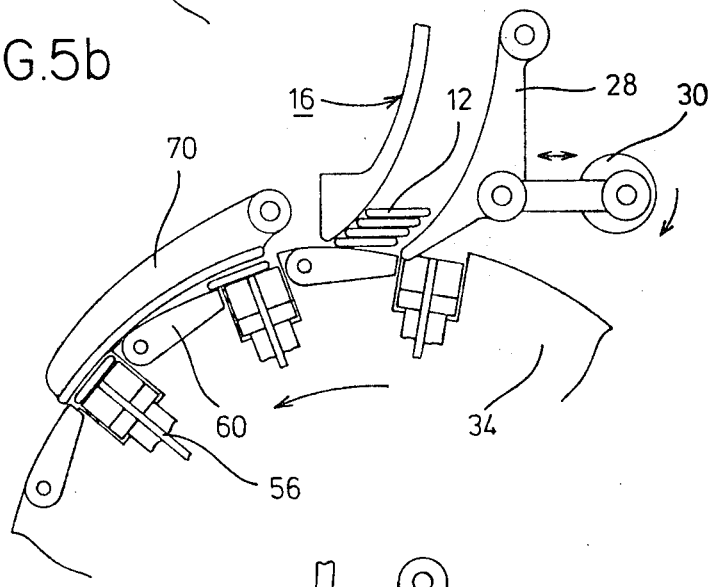
Figure 5C:
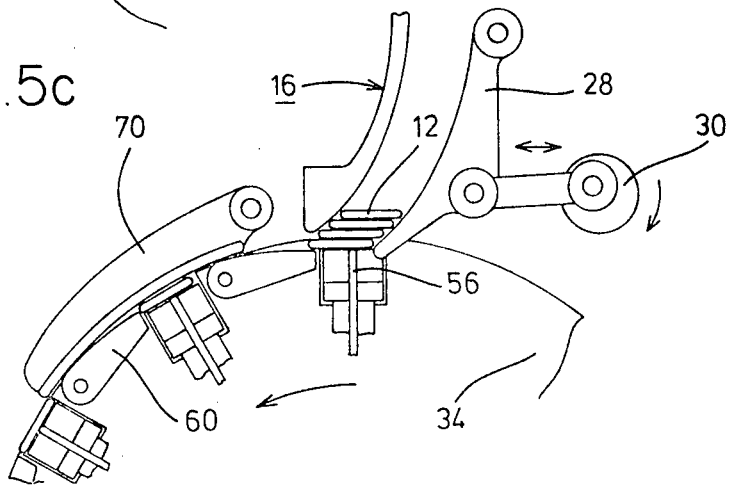

As illustrated in FIG. 5, when the recess 36 of the first rotating drum 18 arrives under the bottom opening 32 of the hopper 16, the plunger 38 in the recess 36 is moved until a top surface of the carrier 38*a* of the plunger 38 comes to a position which is stepped down from the circumferential surface of the body 34 by the thickness of one gum piece 12 and the cam follower 64 of the lever member 60 is urged into contact with the cam 74 projecting from the support frame 72 as shown in FIG. 2, so that the top surface of the support member 60*b* of the lever member 60 comes into the same plane as that of the top surface of the carrier 38*a* of the plunger 38. Thus, the gum piece 12 located in the lowermost position of the hopper 16 is guided onto the carrier 38*a* along the lever member 60 as shown in FIG. 5*a*. Thereafter, the gum piece 12 is directed through the carrier 38*a* beneath the guide member 68 as shown in FIG. 5*b* so that the gum piece 12 is positively placed on the carrier 38*a* under the frictional force of the guide member 68 with the gum piece 12 for the subsequent transfer as shown in FIG. 5*c*. When the gum piece 12 is placed on the carrier 38*a*, the lever member 60 returns to its original position under the force of the spring 66.

The second rotating drum 20 is arranged in relation to the first rotating drum 18 in such a way that an outer circumference of the second rotating drum 20 approaches the outer circumference of the first rotating drum 18 at the terminal end of the guide member 68. Accordingly, when the recess 36 of the first rotating drum 18 receiving the gum piece 12 approaches the outer circumference of the second rotating drum 20, the plunger 38 is somewhat projected externally under the influence of the cam 46 to urge the gum piece in the recess 36 against the circumference of the second rotating drum 20. Upon this operation, the pushing member 56 provided in the plunger 38 is projected from the top of the carrier 38*a* of the plunger 38 under the influence of the cam 46, so that the gum piece is separated from the carrier 38*a* and subsequently urged against the second rotating drum 20. Thus, it will be appreciated that the first rotating drum 18 operates as a feeding drum which collects a piece of the gum sheet from the bottom opening 32 of the hopper 16 for subsequent transfer to the second rotating drum 20.

Figure 6:
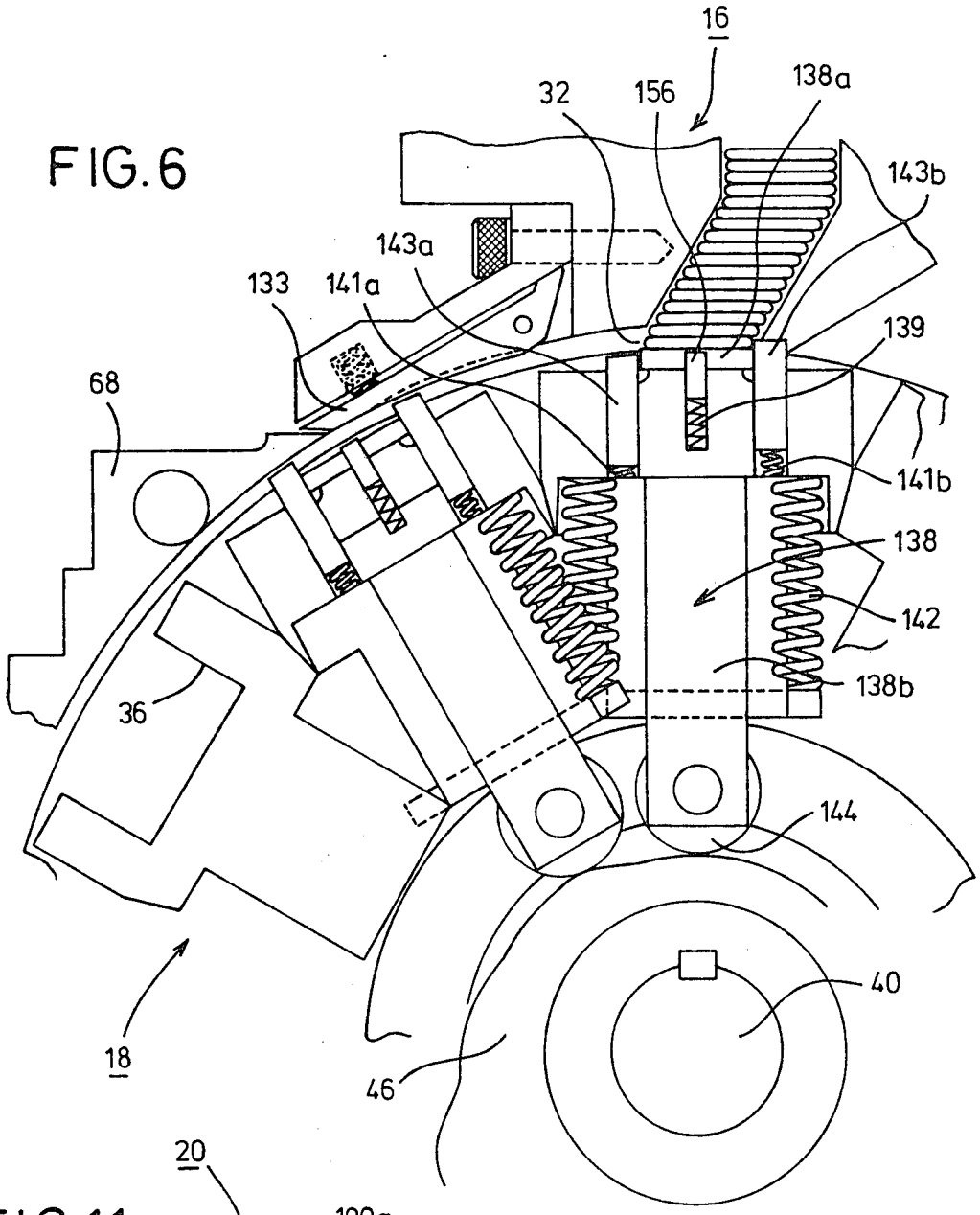
FIG. 6 is a fragmentary enlarged sectional view of the first rotating drum of another embodiment.

Alternatively, the plunger 38 may be devised as shown in FIG. 6. Namely, in FIG. 6, the plunger 138 is provided at its external end with a carrier 138*a* of substantially the same size as the gum piece 12 and from this carrier 138*a* a rod 138*b* extends toward the center shaft 40 of the drum 18. The rod 138*b* is externally provided with a coil spring 142 to urge resiliently the rod 138*b* toward the center axis of the drum 18. Furthermore, the rod 138*b* at its one end is connected to a cam follower 144 which is urged into contact with the cam 46 fixed to the center shaft 40.

In the middle portion of the carrier 138*a* is housed a pushing member 156 which resiliently projects externally under the force of a coil spring 139. Moreover, the carrier 138*a* at its opposite sides is provided with separate side plates 143*a*, 143*b* which resiliently project externally under the force of the coil springs 141*a*, 141*b* so that the gum piece 12 is embraced by these side plates 143*a*, 143*b* for positive holding of the gum piece on the carrier 138*a*.

In this alternative embodiment of the plunger 138, the hopper 16 is provided with at its bottom or its portion registering with the first rotating drum 18 a supporting table 133 which determines the height of the bottom opening 32.

When the side plate 143*a* of the plunger 138 is brought into contact with the supporting table 133, the side plate 143*a* is forced down to the level of the carrier 138*a* so that the gum piece located at the bottom of the hopper 16 is removed by the side plate 143*b* for subsequent placement on the carrier 138*a*.

Thus, the plunger 138 holding the gum piece on the carrier 138*a* and encompassed by the side plates 143*a*, 143*b* within the guide member 68 is moved to approach the circumference of the second rotating drum 20 where the plunger 138 is projected under the influence of the cam 46 and the pushing member 156 provided in the carrier 138*a* is also projected outwardly for effecting a smooth transfer of the gum piece against the circumference of the second rotating drum 20.

It will be appreciated that the arrangement of the first rotating drum 18 according to the alternative embodiment as shown in FIG. 6 is simpler in its structure than that of FIGS. 1–5.

The second rotating drum 20 is comprised of a drum body 76 of the same size as that of the first rotating drum 18 and on an outer circumference of the drum body 76 are provided at equal distances receiving members 78 of the same number as the recesses 36 provided in the outer circumference of the first rotating drum 18.

The receiving member 78 is provided with a cavity 80 of a depth sufficient to receive a piece of the gum sheet 12 and from the receiving member 78 a rod 84 (FIG. 7) extends toward the center shaft 82 of the drum body 76. The rod 84 is partially surrounded by a coil spring to urge resiliently the receiving member 78 toward the center shaft of the drum body 76.

The rod 84 carries at its inner end a cam follower 86 which is urged into contact with a cam 88 fixed to the center shaft 82. At the opposite sides of the receiving member 78, there are arranged the lever members 90, 92 which are pivoted at their one ends so that the opposite ends thereof may close with each other to wrap the gum piece 12 with the wrapping paper within the cavity 80 of the receiving member 78.

Figure 7:
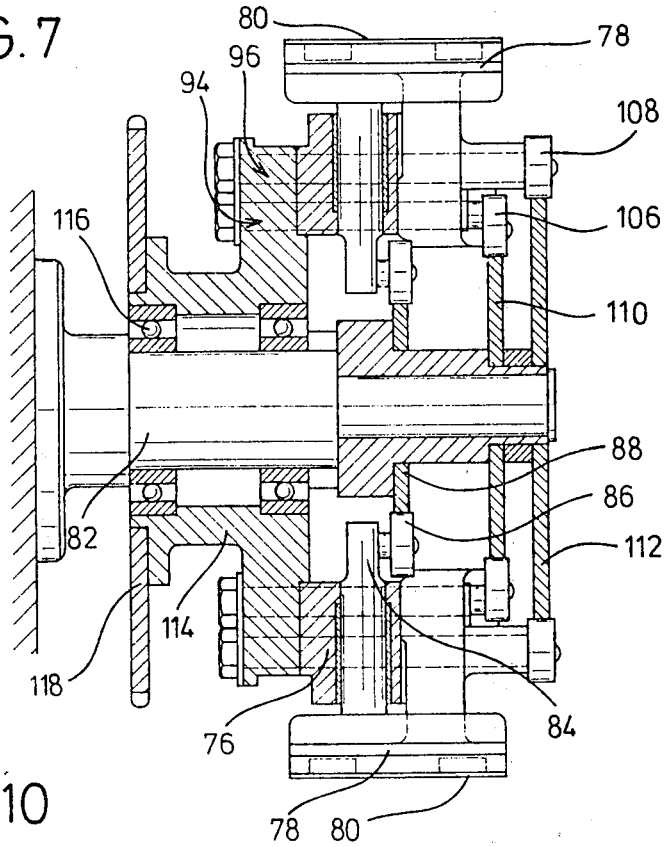
FIG. 7 is a sectional view of the second rotating drum taken along the lines VI—VI of FIG. 1.

The lever members 90 and 92 include the bell cranks 98 and 100 which are pivoted on support pins 94 and 96 respectively and provided at their external ends with the claws 102 and 104 which operate to cover the surface of the receiving member 78. On the bell cranks 98 and 100 are mounted the cam followers 106 and 108 which are urged into contact with the cams 110 and 112 as shown in FIGS. 1 and 7.

To the drum body 76 of the second rotating drum 20 is secured a hub 114 (FIG. 7) which is mounted on a bearing 116 around a center shaft 82 inserted into the drum body 76 and also connected to a convenient driving source through a sprocket 118.

Above the second rotating drum 20 there is arranged a paper feeding unit 22 for supplying a wrapping paper sheet 120. The paper feeding unit 22 includes a number of rollers with a cutter unit 122 which cuts the continuously supplied wrapping paper sheet 120 into a wrapping paper piece 124 of predetermined size.

One of the lever members 92 arranged proximate to the receiving member 78 is provided with an inlet port 126 (FIG. 8) to draw and hold the spread wrapping paper 124 in the cavity 80 under the influence of air suction. The second rotating drum 20 and the first rotating drum 18 come close together so that the gum piece 12 is transferred into the cavity 80 of the receiving member 78 for retention therein together with the wrapping paper 124.

The operations of the first and second rotating drums 18 and 20 will further be illustrated with reference to FIG. 8. Before the recesses 36 of the first rotating drum 18 and the receiving member 78 of the second rotating drum 20 close together, the claws 102 and 104 secured to the lever members 90 and 92 of the second rotating drum 20 open the receiving member 78 completely to receive the wrapping paper 124 therein whereas the plunger 38 of the first rotating drum 18 operates to push the gum piece outwardly under the influence of the cam 46 as shown in FIG. 8*a* so that the gum piece 12 is progressively transferred into the cavity 80 of the receiving member 78 as shown in FIG. 8*b*. After the first and second rotating drums 18 and 20 close together, the gum piece 12 with the wrapping paper 124 are fully received in the cavity 80 of the receiving member 78 as shown in FIG. 8*c*. When the first rotating drum 18 is further turned after the gum piece 12 has been received in the receiving member 78 of the second rotating drum 20 the plunger 38 of the first rotating drum 18 is retracted with projection of the pushing member 56 associated with the plunger 38 under the influence of the cam 59 to push at its extremity the gum piece to be held as shown in FIG. 8*d*.

On the other hand, on the second rotating drum 20, the lever members 90 and 92 approach progressively under the influence of the cams 110 and 112 so that the claws 102 and 104 fold the wrapping paper 124 about the opposite sides of the gum piece 12 while holding the gum piece 12 as shown in FIG. 8*d*.

Figure 9:
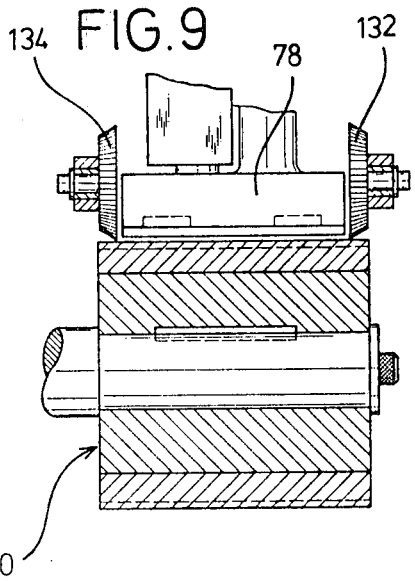
FIG. 9 is a sectional view of the first rotating drum taken along the line VIII—VIII of FIG. 1.
Figure 12A:
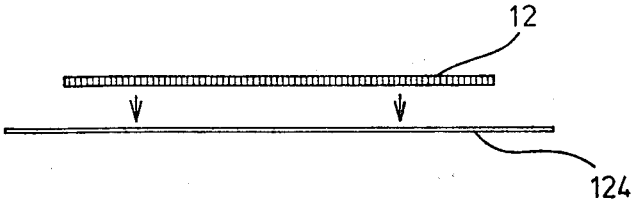
FIGS. 12*a* to 12*f* are schematic views showing the wrapping operation of a gum piece with wrapping paper.
Figure 12B:
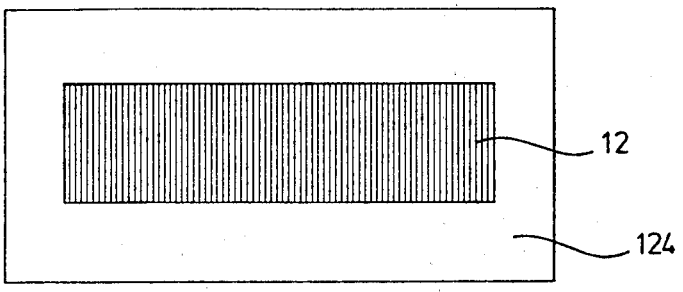
Figure 12C:
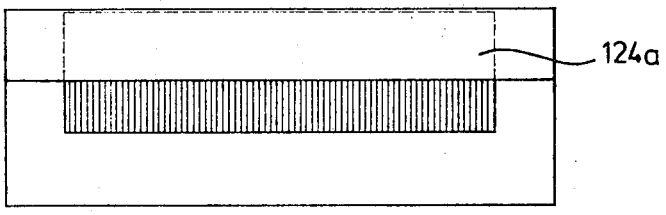
Figure 12D:
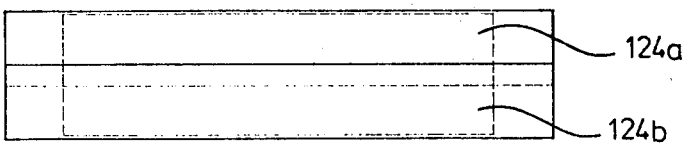
Figure 12E:
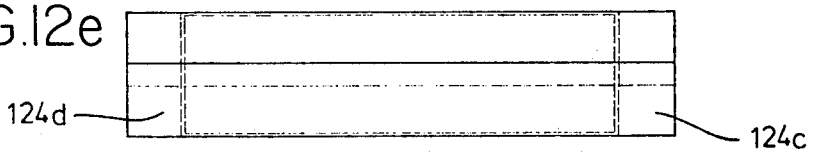
Figure 12F:
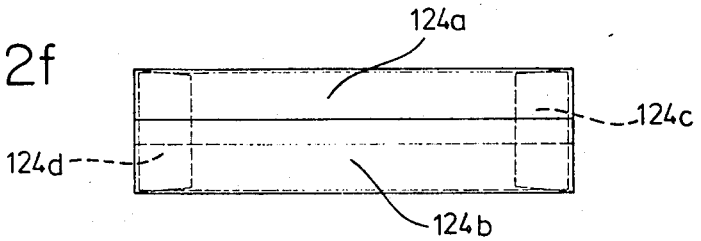

The second rotating drum 20 holding the gum piece further turns with a rapid forward movement of the lever member 90 positioned rearwardly of the turning direction of the drum 20 against the receiving member 78 under the influence of the cam 110 and as a result the wrapping paper 124 at its one side 124*a* is wrapped onto the gum piece as shown in FIG. 8*d*. Subsequently, the gum piece held by the lever members 90 and 92 is led into the guide member 128 so that the wrapping paper 124 at its opposite side 124*b* is wrapped symmetrically on the gum piece for completing the preliminary wrapping operation during turning of the second rotating drum 20 through approximately 90°. The gum piece thus preliminarily wrapped is further passed between a pressure roller 130 and a pair of rotating blades 132, 134 for holding the opposite ears 124*c* and 124*d* (FIG. 12) of the wrapping paper 124 as shown in FIG. 9 and is in turn carried into the guide holder 136 so that the ears 124*c* and 124*d* of the wrapping paper may be folded at 90° to 180°.

Figure 10:
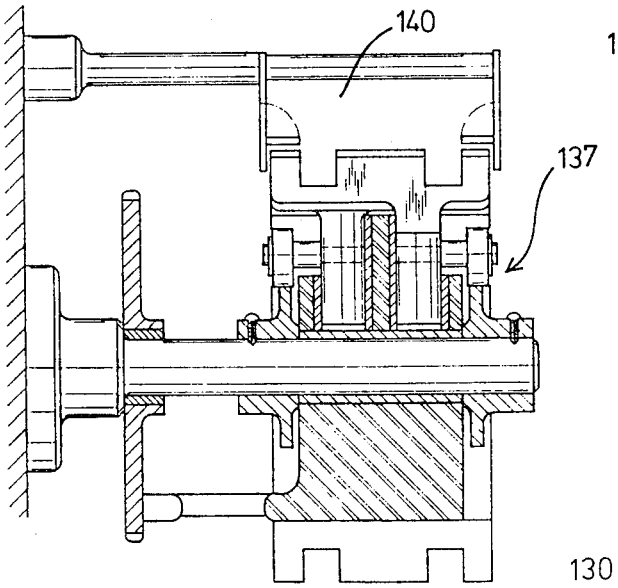
FIG. 10 is a sectional view of the first rotating drum taken along the line IX—IX of FIG. 1.

At the terminal end of the guide holder 136 there is arranged a third rotating drum 137 in proximity to the second rotating drum 20. Along the periphery of the third rotating drum 137 is provided a guide holder 140 adapted to fold the opposite ears of the wrapping paper positively as shown in FIGS. 1 and 10.

Figure 11:
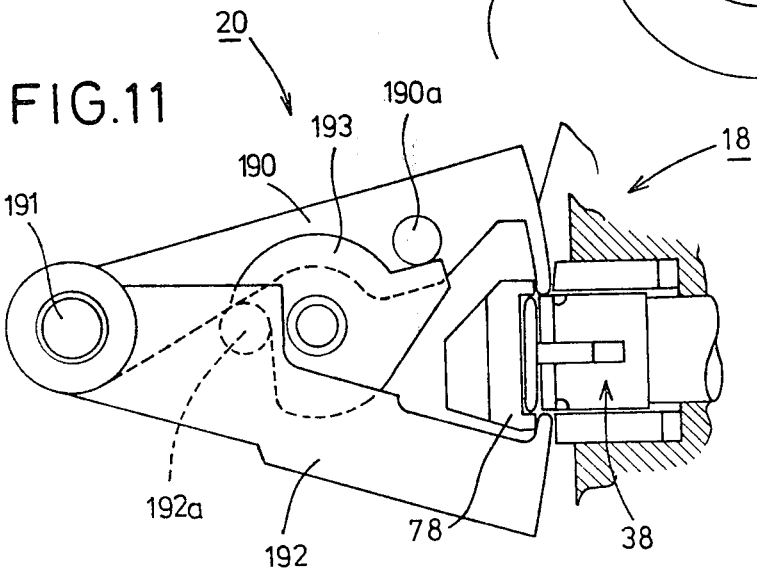
FIG. 11 is a fragmentary enlarged sectional view of the second rotating drum of another embodiment.

Alternatively, the lever members 90 and 92 to be arranged at the opposite sides of the receiving member 78 positioned in the second rotating drum 20 may be formed as shown in FIG. 11 wherein the lever members 190 and 192 at their one ends are pivoted to a common axis 191 and the lever members 190 and 192 are provided with the pins 190*a* and 192*a* which are urged into contact with a cam follower 193 which is displaced by a fixed cam (not shown).

From the foregoing description, it will be appreciated that the apparatus according to the invention essentially comprises two rotating drums one of which serves to feed the gum piece whereas the opposite drum serves to wrap the gum piece with a high efficiency.

In FIG. 12, the wrapping operation is illustrated more clearly in relation to the gum piece 12 and the wrapping paper 124. Namely, as best shown in FIG. 12*a*, the wrapping paper 124 and the gum piece 12 are positioned in parallel and then the gum piece 12 is placed on the middle portion of the wrapping paper 124. Thereafter, one side portion 124*a* of the wrapping paper 124 is folded as shown in FIG. 12*c* and then the opposite side portion 124*b* of the wrapping paper 124 is folded as shown in FIG. 12*d* and subsequently the folding lines are provided in the ears 124*c* and 124*d* formed at the opposite ends of the wrapping paper as shown in FIG. 12*e* for the ultimate folding of the ears 124*c* and 124*d* to complete the wrapping operation as shown in FIG. 12*f*.

As hereinbefore fully described, the apparatus in accordance with the invention includes the feeding drum and the wrapping drum with the hopper and the wrapping paper feeding mechanism which makes it possible to perform a continuous operation with a simple maintenance of the apparatus.

For convenience in understanding, the foregoing embodiments show wrapping a single wrapping paper on the gum piece. In order to wrap an additional wrapping paper a third rotating drum (not shown) may be used as a feeding drum (also not shown) in association with a fourth rotating drum which serves as a wrapping drum.

Furthermore, in place of the pushing plate provided in the plunger, provision may be made of an air inlet and outlet means (not shown) to suck the article for holding and releasing the article for discharging it against the wrapping drum.

Moreover, in place of the hopper for storing the gum pieces therein, a continuous gum piece provided with the cutting lines may be supplied on the periphery of the feeding drum which catches a cut gum piece.

In one example, twelve recesses are provided in the periphery of the feeding drum so that approximately 3,000 gum pieces may be wrapped per minute which is a production approximately twice that of conventional devices.

What is claimed is:

1. Apparatus for continuously wrapping a sheet article, comprising means for cutting an elongated sheet article into a predetermined size for continuous supply, a feeding drum rotatably mounted about an axis for transferring each cut piece of the sheet while holding the cut piece on the circumference of the feed drum, a wrapping drum directly confronting said feed drum and provided about its circumference with means for receiving the cut sheet article, paper feed mechanism for continuously supplying wrapping paper to the wrapping drum, means for rotating said feeding and wrapping drums, and means for transferring the cut sheet article from the feeding drum to the wrapping drum, said transferring means comprising a plunger radially carried by the feeding drum which at its radially inner end has a cam follower which is in contact with a cam for operating the plunger to transfer said cut sheet article from said transfer drum into said wrapping drum receiving means, a pushing member radially carried by the radially outer end of the plunger and the radially inner end of which pushing member has another cam follower which is in contact with another cam for operating the pushing member to urge the pushing member outwardly of the feeding drum relative to the plunger to support and hold the cut sheet article within said wrapping drum receiving means after withdrawal of said plunger.

2. Apparatus as claimed in claim 1, in which the means for cutting the sheet article into a predetermined size comprises two separate rolls for embracing the sheet article previously provided with cutting lines, one said roll being on the receiving side of the article and the other roll being on the delivery side of the article, the peripheral velocity of the roll positioned on the delivery side of the article being greater than the velocity of the roll positioned on the receiving side of the article.

3. Apparatus as claimed in claim 1, in which the means for continuously supplying the sheet article comprises a hopper which is arranged proximate to the cutting means for receiving each cut piece of the sheet article in superposition and associated with a vibrator, the bottom of said hopper being open to expose the cut pieces to the circumference of the feeding drum.

4. Apparatus as claimed in claim 1, in which the feed drum about its circumference is provided with a number of equally spaced recesses, each recess communicating with a chamber in which is disposed a plunger for pushing the sheet article outwardly.

5. Apparatus as claimed in claim 1, in which the wrapping drum about its circumference is provided with a number of article receivers and each said article receiver is associated with a first lever member for folding one side of the wrapping paper and a second lever member for folding the opposite side of the wrapping paper, at least one of said lever members being provided with a suction port for attracting the wrapping paper and one end of each lever member being operatively associated with a cam follower which is in turn urged into contact with a fixed cam.

6. Apparatus as claimed in claim 1, in which the wrapping drum about its circumference is provided with a plurality of article receivers and each said article receiver is associated with a first lever member for folding one side of the wrapping paper and a second lever member for folding opposite side of the wrapping paper, at least one of said lever members being provided with a suction port for attracting the wrapping paper and the lever members being pivoted to a common shaft while each lever member is provided with a pin engaged with a cam follower which is in turn urged into contact with a fixed cam.

7. Apparatus as claimed in claim 1, in which the paper feed mechanism includes roller units disposed above the wrapping drum and a cutting unit, wherein a wrapping paper sheet continuously supplied is cut into a predetermined size and then the cut pieces are fed seriatim onto an article receiver of the wrapping drum.

8. Apparatus as claimed in claim 1, in which the plunger is resiliently suspended in a recess in the circumference of the feeding drum.

9. Apparatus as claimed in claim 1, in which the plunger is disposed in abutment with a lever member, said lever member being tilted when proximate to the bottom of the hopper to guide the sheet article into a cavity formed in the extremity of the plunger.

10. Apparatus as claimed in claim 1, in which the feeding drum and the wrapping drum are rotated at identical peripheral velocity.

* * * * *